US009369789B2

(12) United States Patent
Sato

(10) Patent No.: US 9,369,789 B2
(45) Date of Patent: Jun. 14, 2016

(54) SPEAKER DEVICE

(71) Applicant: KYUSHU INSTITUTE OF TECHNOLOGY, Kitakyushu-shi (JP)

(72) Inventor: Yasushi Sato, Kitakyushu (JP)

(73) Assignee: KYUSHU INSTITUTE OF TECHNOLOGY, Kitakyushu-Shi, Fukuoka (JP)

( * ) Notice: Subject to any disclaimer, the term of this patent is extended or adjusted under 35 U.S.C. 154(b) by 0 days.

(21) Appl. No.: 14/377,046

(22) PCT Filed: Dec. 11, 2012

(86) PCT No.: PCT/JP2012/082004

§ 371 (c)(1),
(2) Date: Aug. 6, 2014

(87) PCT Pub. No.: WO2013/118384

PCT Pub. Date: Aug. 15, 2013

(65) Prior Publication Data

US 2015/0003658 A1 Jan. 1, 2015

(30) Foreign Application Priority Data

Feb. 8, 2012 (JP) ..... 2012-025446

(51) Int. Cl.
*H04R 25/00* (2006.01)
*H04R 1/02* (2006.01)
(Continued)

(52) U.S. Cl.
CPC ..... *H04R 1/025* (2013.01); *H04R 1/24* (2013.01); *H04R 1/2842* (2013.01); *H04R 9/066* (2013.01); *H04R 9/18* (2013.01); *H04R 2207/00* (2013.01); *H04R 2499/11* (2013.01)

(58) Field of Classification Search
CPC ..... H04R 1/24; H04R 1/26; H04R 1/2807; H04R 1/2811; H04R 1/2815; H04R 1/2819; H04R 2201/405; H04R 1/2803; H04R 1/2834
See application file for complete search history.

(56) References Cited

U.S. PATENT DOCUMENTS 3,688,864 A * 9/1972 Guss ..... H04R 1/26 181/145
4,064,966 A * 12/1977 Burton ..... H04R 1/2842 181/144

(Continued)

FOREIGN PATENT DOCUMENTS

JP 63-190497 A 8/1988
JP 63-260394 A 10/1988

(Continued)

OTHER PUBLICATIONS

International Search Report (PCT/ISA/210) mailed on Jan. 15, 2013, by the Japanese Patent Office as the International Searching Authority for International Application No. PCT/JP2012/082004.

*Primary Examiner* — Curtis Kuntz
*Assistant Examiner* — Ryan Robinson
(74) *Attorney, Agent, or Firm* — Buchanan Ingersoll & Rooney PC

(57) ABSTRACT

A cabinet to which a speaker unit is attached is configured to have an enclosed space where sound waves outputted from the rear surface of the speaker unit are transmitted, a sound guide space separated from the enclosed space, and an outlet for the sound waves transmitted in the sound guide space. A diaphragm is positioned between the enclosed space and the sound guide space of the cabinet, and an actuator is attached to the diaphragm. An audio signal shared with the speaker unit is supplied to the actuator, and diaphragm vibrations are enhanced by the actuator.

6 Claims, 5 Drawing Sheets

(51) Int. Cl.

| | |
|---|---|
| ***H04R 1/24*** | (2006.01) |
| ***H04R 1/28*** | (2006.01) |
| *H04R 9/18* | (2006.01) |
| *H04R 9/06* | (2006.01) |

(56) References Cited

U.S. PATENT DOCUMENTS 4,325,454 A * 4/1982 Humphrey ..... H04R 1/2819 181/145
5,191,619 A * 3/1993 Hayase ..... H04R 1/2819 381/96
5,327,504 A * 7/1994 Hobelsberger ..... H04R 1/227 381/350
5,815,589 A * 9/1998 Wainwright ..... H04R 3/14 181/144
6,363,157 B1 * 3/2002 Chick ..... H04R 1/26 381/89
6,816,598 B1 * 11/2004 Budge ..... H04R 3/12 381/89
7,513,332 B2 * 4/2009 Moore ..... H04R 1/02 181/152

FOREIGN PATENT DOCUMENTS

JP 6-178386 A 6/1994
JP 2008-131541 A 6/2008

* cited by examiner

SPEAKER DEVICE

TECHNICAL FIELD

The present invention relates to speaker devices, and particularly relates to a back load horn type speaker device which performs reproduction of deep bass sound efficiently.

BACKGROUND ART

Conventionally, there is known a back load horn type speaker device as a speaker device accommodating a speaker unit in a housing. The back load horn type speaker device amplifies and outputs sound waves outputted from back side of the speaker unit in a space within the housing (back load horn), and can enhance bass range sound.

Patent literature 1 discloses an example of the back load horn type speaker device. The speaker device described in this patent literature 1 has a configuration provided with an enclosed space (air chamber) on the backside of a speaker unit, and further provided with a sound guide tube (back load horn) which is connected to the enclosed space. The speaker device described in patent literature 1 can enhance and output bass sound through the sound guide tube.

CITATION LIST

Patent Literature

PTL 1: Japanese Patent Laid-Open No. 2008-131541

SUMMARY OF INVENTION

Technical Problem

The conventional back load horn speaker device, however, enhances sound outputted from the back side of the speaker unit by an action between the air chamber and the back load horn, and therefore needs a comparatively large volume for the air chamber and the back load horn, and there is a problem that the size of the speaker device is increased.

Meanwhile, for a speaker device used for a home theater or the like, a thin and small type is spread as a display becomes thinner. For the thin type speaker device used for such a use, although bass range sound tends to be lacking, it is difficult to apply the back load horn type speaker device proposed conventionally to the thin type speaker device without change.

An object of the present invention is to provide a speaker device which can perform reproduction of bass range sound efficiently and is suitable for downsizing and thinning.

Solution to Problem

According to the present invention, a cabinet to which a speaker unit is attached is configured to have an enclosed space where sound waves outputted from the rear surface of the speaker unit are transmitted, a sound guide space separated from the enclosed space, and an outlet for the sound waves transmitted in the sound guide space.

Then, a diaphragm is positioned between the enclosed space and the sound guide space of the cabinet, and an actuator is attached to the diaphragm. An audio signal shared with the speaker unit is supplied to the actuator, and diaphragm vibrations are enhanced by the actuator.

According to the present invention, the vibration of the diaphragm within the cabinet acts so as to enhance bass range sound outputted from the speaker unit, and it is possible to obtain a speaker device having preferable frequency characteristics in which the bass range sound is enhanced.

DESCRIPTION OF EMBODIMENTS

Hereinafter, an example of an embodiment in the present invention (called "present example" in the following) will be explained with reference to the attached drawings.

A speaker device of the present example is configured as a back load horn type speaker device. That is, the speaker device outputs sound waves to the foreside from a speaker unit attached to the front surface of a cabinet, and also outputs bass range sound waves outputted from the rear surface of the speaker unit from an outlet at the front surface of the cabinet via a space within the cabinet. The sound waves outputted from the back side of the speaker unit is outputted from the outlet at the front surface of the cabinet after having been enhanced by a diaphragm positioned within the cabinet.

Figure 1:
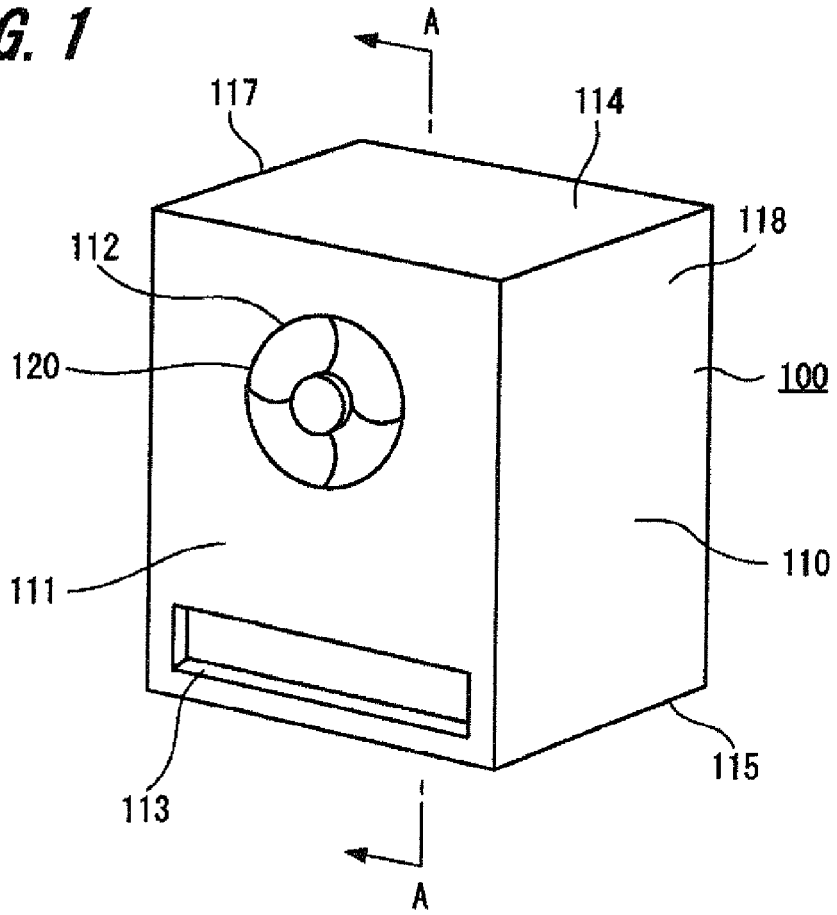
FIG. 1 is a perspective view of a speaker device according to an example of an embodiment in the present invention.

FIG. 1 is a diagram showing an outer shape of the speaker device of the present example. A speaker device 100 uses a box type cabinet 110 as a housing. The cabinet 110 is configured with wood. Here, the wood includes a wood such as a plate material cut out from timber and a chipboard, and, in addition, includes a woody board formed from wood fibers such as wood chips using resin. Further, material other than the woody material may be used if the material has a strength applicable to the speaker cabinet. The cabinet 110 is formed into a box shape by assembling a front surface plate 111, a top face plate 114, a bottom face plate 115, a rear face plate 116 and right and left side face plates 117 and 118.

The front surface plate 111 of the cabinet 110 has a circular unit attachment hole 112 near the center thereof, and a speaker unit 120 is attached to the unit attachment hole 112. Further, a sound guide space outlet 113 to be described below is provided in the lower part of the front surface plate 111 of the cabinet 110.

A dynamic type speaker unit is used as the speaker unit 120, for example. The dynamic type speaker unit vibrates a diaphragm having a circular cone shape or the like by the drive of a voice coil to output sound waves. For the diaphragm provided at the dynamic type speaker unit, paper, resin, metal, or the like is used.

The speaker unit 120 is a full range type speaker unit which can reproduce sound waves in the whole audible band with one unit. For example, the speaker unit 120 has characteristics capable of reproducing sound waves in a frequency range of 20 Hz to 20 kHz. Note that the speaker unit 120 does not always have flat frequency characteristics in the frequency range of 20 Hz to 20 kHz, and has an output level lower particularly in a low frequency range near 20 Hz than in a high frequency range.

Figure 2:
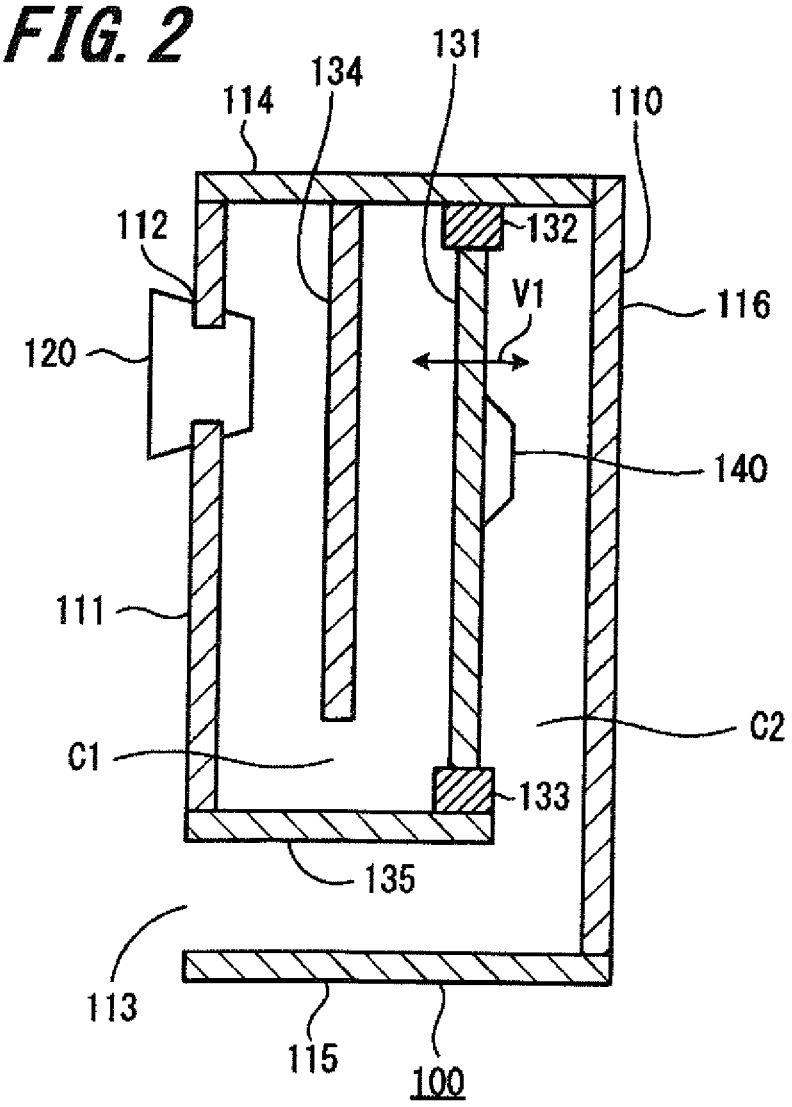
FIG. 2 is a cross-sectional view along an A-A line of FIG. 1 showing an inside of the speaker device according to the example of the embodiment in the present invention.
Figure 3:
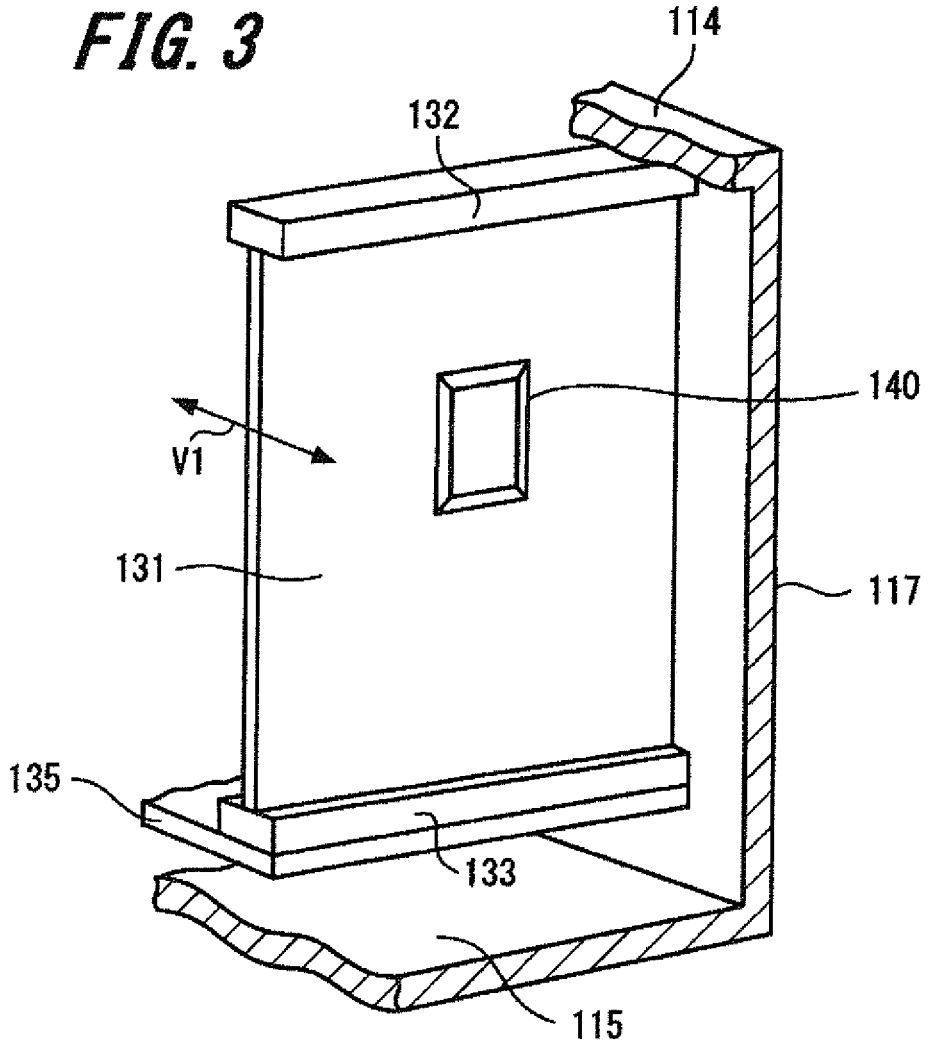
FIG. 3 is a partial perspective view showing an actuator disposition state of the speaker device according to the example of the embodiment in the present invention.

FIG. 2 is a cross-sectional view showing an inner configuration of the speaker device 100, and FIG. 3 is a diagram showing a diaphragm 131 and its peripheral when the inside of the cabinet is cut.

The front surface plate 111 of the cabinet 110 has the unit attachment hole 112 and the sound guide space outlet 113 which are shown in FIG. 1. As shown in FIG. 2, the speaker unit 120 is attached to the unit attachment hole 112.

An enclosed space C1 is formed inside the cabinet 110 on the rear surface side of the speaker unit 120. This enclosed space C1 is formed by means of partitioning the inside of the cabinet with the diaphragm 131 and a partition wall 135 of the bottom part. The diaphragm 131 and the partition wall 135 contact the right and left side face plates 117 and 118 (refer to FIG. 1). With such a configuration, the rear surface side of the speaker unit 120, that is, the position where sound waves are outputted to the inside of the cabinet becomes the enclosed space C1 separated from the outside. A separation plate 134 is positioned in the enclosed space C1 of the cabinet 110. The separation plate 134 is positioned for securing a distance across which the sound wave outputted from the rear surface of the speaker unit 120 to the enclosed space C1 reaches the diaphragm 131, and there is provided a gap between the separation plate 134 and the partition wall 135 which is supported by the upper face plate 111 and the side face plates 117 and 118.

The diaphragm 131 is a plate having a comparatively high stiffness and is formed by a plate such as a wood having a comparatively large thickness of approximately 10 mm. When the diaphragm 131 is a diaphragm having a high stiffness and a certain thickness, the diaphragm 131 vibrates at comparatively low frequencies not higher than 300 Hz, for example. Then, vibration is suppressed at high frequencies higher than 300 Hz. This diaphragm 131 is supported to the cabinet 110 by support members 132 and 133 positioned at the top and bottom thereof, respectively. The wood configuring this diaphragm 131 may be formed by a woody board formed from wood fibers such as wood chips using resin and a material rather than wood, similar to the wood configuring the cabinet 110.

The diaphragm 131 is provided with an actuator 140 approximately at the center part thereof. The actuator 140 will be described below. The upper support member 132 is connected to the top face plate 114 of the cabinet 110. The lower support member 133 is connected to the partition wall 135 inside the cabinet.

The space except the enclosed space C1 inside the cabinet 110 is a sound guide space C2. This sound guide space C2 is formed by a space between the diaphragm 131 and the rear face plate 116, and a space between the partition wall 135 and the bottom face plate 115, and communicates with the outside through the sound guide space outlet 113 provided in the front surface plate 111. The sound guide space C2 is a sound guide space (back load horn) for causing the speaker device 100 to function as the back load horn type. The distance from the diaphragm 131 to the sound guide space outlet 113 is set to be comparatively long for enhancing bass sound transmitted through the sound guide space C2. The sound guide space C2 and the enclosed space C1 are formed so as to have the same volume. Further, the enclosed space C1 and the sound guide space C2 are formed so that a sound wave outputted from the speaker unit 120 to the outside and the sound wave outputted from the sound guide space outlet 113 after transmitted from the diaphragm 131 through the sound guide space C2 have the same phase.

As shown in FIG. 2, the diaphragm 131 is positioned between the enclosed space C1 and the sound guide space C2, and vibrates with the sound waves outputted from the rear surface side of the speaker unit 120. Then, the sound waves generated by the vibration of the diaphragm 131 is transmitted through the sound guide space C2 and outputted from the sound guide space outlet 113 to the outside. A direction V1 shown in FIG. 2 and FIG. 3 in which the diaphragm 131 vibrates is the direction in which the diaphragm 131 moves back and forth inside the cabinet 110.

Here, the diaphragm 131 is formed by a comparatively thick plate, and therefore the diaphragm 131 vibrates only with low frequency range sound waves among the sound waves transmitted through the enclosed space C1 from the rear surface of the speaker unit 120. On this occasion, the actuator 140 attached to the diaphragm 131 acts so as to enhance the vibration of the diaphragm 131.

Figure 4:
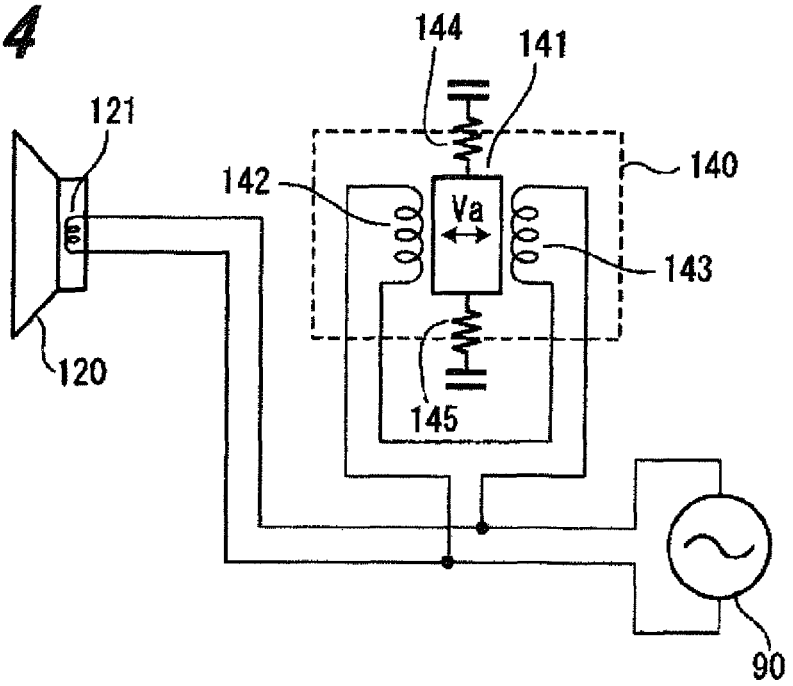
FIG. 4 is a configuration diagram showing a connection state according to the example of the embodiment in the present invention.

FIG. 4 is a diagram showing a connection configuration of an audio signal source 90, and the speaker unit 120 and the actuator 140 inside the speaker device 100.

The signal line supplying an audio signal from the audio signal source 90 is connected to a voice coil 121 of the speaker unit 120. Then, the audio signal is supplied to the voice coil 121 from the audio signal source 90 and thereby the diaphragm provided in the speaker unit 120 vibrates.

Then, the signal line supplying the audio signal from the audio signal source 90 is connected to the actuator 140.

The actuator 140 is a drive mechanism performing linear back-and-forth movement according to an input signal. As shown in FIG. 4, the actuator 140 includes two sets of coils 142 and 143, and the two sets of coils 142 and 143 are connected in series. Then, when polarity change occurs in the signal waveform supplied to the coils 142 and 143, a magnet 141 moves back and forth in a linear direction Va. The magnet 141 is hung by springs 144 and 145 swingably. The direction Va in which the magnet 141 moves back and forth is set to be the same as the direction V1 (FIG. 2 and FIG. 3) in which the diaphragm 131 attached with the actuator 140 vibrates.

In the present example, as shown in FIG. 4, the signal line supplying the audio signal from the audio signal source 90 is connected to the coils 142 and 143 of the actuator 140. Then, the audio signal is supplied to the coils 142 and 143 from the audio signal source 90 and thereby the actuator 140 moves back and forth.

Here, the actuator 140 is set to have a resonance frequency at a comparatively low frequency. For example, the actuator 140 is set to have a resonance frequency of approximately 40 Hz so as to vibrate when the signal of approximately 20 Hz to approximately 300 Hz is inputted. Note that the resonance frequency of the actuator 140 is determined by the stiffness of the springs 144 and 145 hanging the magnet 141, the mass of the magnet 141, and the like.

Next, there will be explained the operation of the speaker device 100 in the present example for outputting sound waves.

The speaker unit 120 outputs sound waves from the front surface of the cabinet 110 according to the audio signal waveform supplied to the voice coil 121. Further, the speaker unit 120 outputs a sound wave having a phase opposite to the phase of the sound wave outputted to the front surface side, from the back side of the speaker unit 120 to the enclosed space C1 of the cabinet 110.

Then, the sound waves transmitted through the enclosed space C1 from the speaker unit 120 is delayed within the enclosed space C1 and vibrates the diaphragm 131 within the cabinet 110. The diaphragm 131 vibrates only with sound waves in a low frequency range not higher than approximately 300 Hz, since the diaphragm 131 is formed of a high stiffness material.

Here, it is important that the delay time of the sound wave within the enclosed space C1 is set so that the phase of the sound wave is inverted when the sound wave reaches the diaphragm 131.

If the delay time is set in this manner, when the sound wave reaches the diaphragm 131, the phase of the sound becomes the same as that of the vibration in the actuator 140 attached to the diaphragm 131, and therefore the vibration of the diaphragm 131 is enhanced. That is, as shown in FIG. 4, the common audio signal is inputted into the speaker unit 120 and the actuator 140, and the actuator 140 acts so as to enhance the vibration of the diaphragm 131 caused by the low frequency sound generated by the speaker unit 120.

Figure 5A:
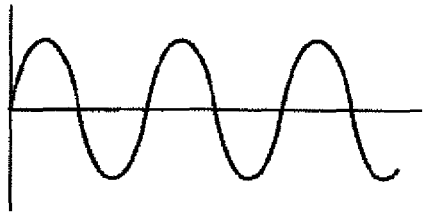
FIGS. 5A to 5C are explanatory diagrams showing a waveform example in each part according to the example of the embodiment in the present invention.
Figure 5B:
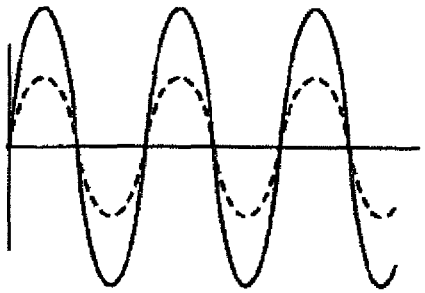
Figure 5C:
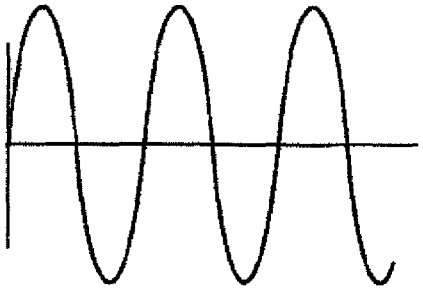

FIGS. 5A to 5C are principle diagrams each showing an example of the sound wave outputted from each part of the speaker device 100, and show waveforms when a sound wave having a comparatively low frequency of approximately 40 Hz is outputted. FIG. 5A shows a waveform of the sound wave outputted from the front surface of the speaker unit 120, and FIG. 5B shows a waveform of the sound wave generated by the vibration of the diaphragm 131 within the cabinet 110. FIG. 5C shows a waveform of the sound wave outputted from the sound guide space outlet 113.

As shown in FIG. 5A, when the sound wave is outputted from the front surface of the speaker unit 120, a waveform having an phase opposite to that of the waveform shown in FIG. 5A is outputted to the enclosed space C1 from the rear surface of the speaker unit 120.

Figure 6:
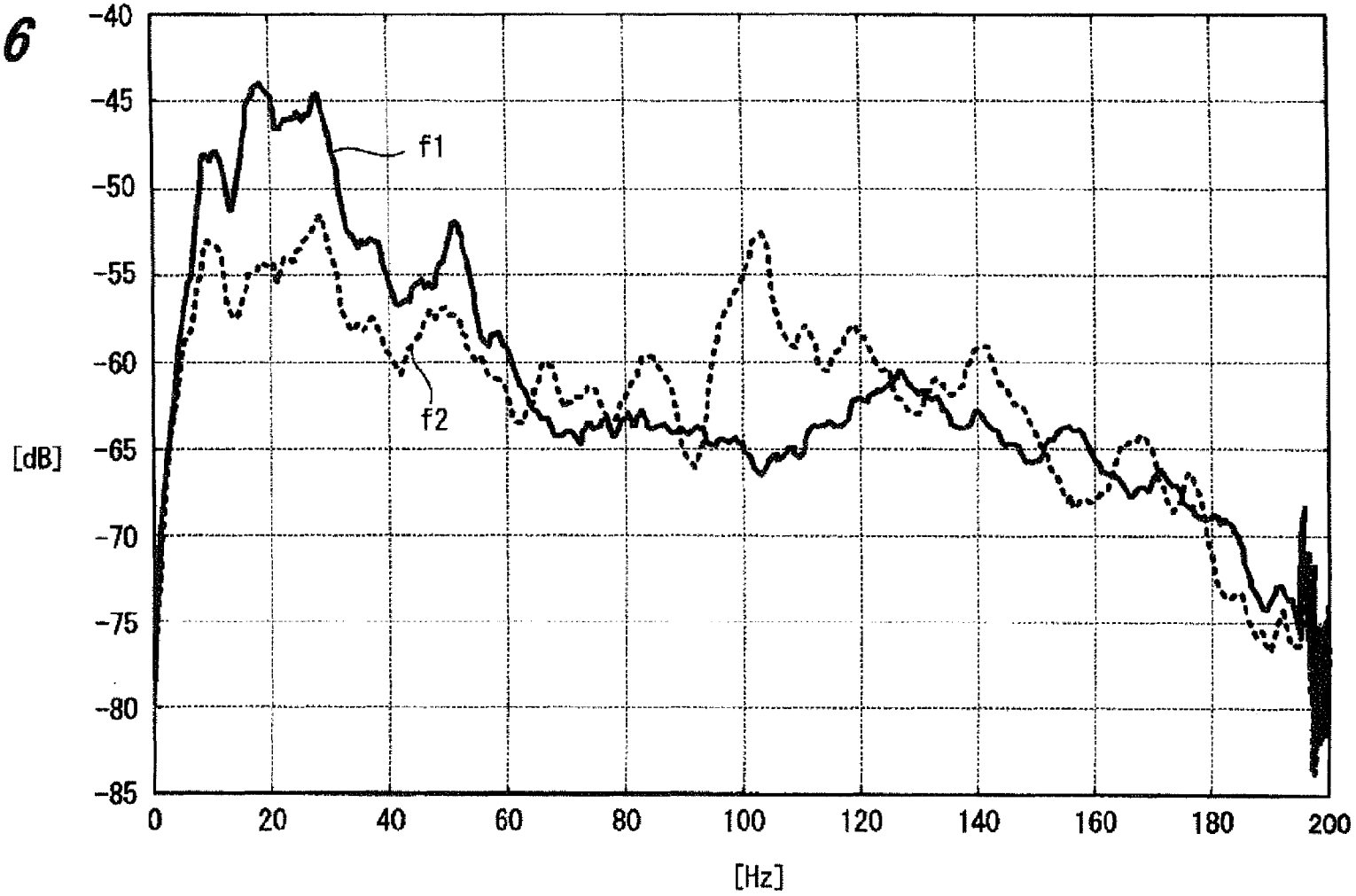
FIG. 6 is a frequency characteristic chart according to the example of the embodiment in the present invention.

The sound wave outputted to this enclosed space C1 is transmitted to the diaphragm 131 to vibrate the diaphragm 131. Here, as explained above, the enclosed space C1 should be designed so that the sound wave obtained by the vibration of the diaphragm 131 and the sound wave outputted from the front surface of the speaker unit 120 have the same phase. Note that, while it is possible to confirm that such a condition is satisfied, by calculation using the volume of the enclosed space C1 and the like, it is also possible to confirm that the formation states of the enclosed space C1 and the sound guide space C2 are correct, from actual measured values of frequency characteristics when the sound wave is outputted actually from the speaker device 100. An example of the frequency characteristics when the enclosed space C1 and the sound guide space C2 are formed correctly will be described below (FIG. 6).

The broken-line waveform shown in FIG. 5B is a waveform of the sound wave when the diaphragm 131 vibrates without the actuator 140. When the actuator 140 is not attached to the diaphragm 131, the diaphragm 131 performs just a passive action, and therefore, as shown by the broken line in FIG. 5B, the level of the sound wave outputted by the diaphragm 131 does not become higher than that of the sound wave outputted by the speaker unit 120 shown in FIG. 5A.

Here, the speaker device 100 of the present example supplies the same signal as the audio signal supplied to the speaker unit 120 also to the actuator 140 attached to the diaphragm 131, and thereby the actuator 140 acts so as to enhance the vibration of the diaphragm 131. That is, the actuator 140 vibrates in synchronization with the vibration shown by the broken line in FIG. 5B, and thereby the sound wave outputted by the diaphragm 131 to the sound guide space C2 becomes an enhanced sound wave as shown by a solid line in FIG. 5B. In this manner, the bass sound enhanced in the diaphragm 131 is outputted to the sound guide space C2.

Then, the bass sound outputted by the diaphragm 131 is enhanced further within the sound guide space C2 and reaches the sound guide space outlet 113. FIG. 5C shows a waveform of the sound wave outputted from the sound guide space outlet 113 to the outside of the speaker device 100. The principle of enhancing the bass sound within the sound guide space C2 is already known as that of the back load horn type speaker device. Note that, since the vibration of the diaphragm 131 is enhanced by the actuator 140, enhanced bass sound is outputted from the sound guide space outlet 113 even without the bass sound enhancement action in the sound guide space C2. The sound guide space C2 is formed so that the waveform of the sound wave outputted by the vibration of the diaphragm 131 (FIG. 5B) and the waveform outputted from the sound guide space outlet 113 (FIG. 5C) also have the same phase.

As explained above, the sound wave outputted directly to the outside from the speaker unit 120 (waveform in FIG. 5A) and the sound wave outputted to the outside from the sound guide space outlet 113 (waveform in FIG. 5C) have the same phase. Therefore, the sound wave outputted to the outside from the sound guide space outlet 113 acts so as to enhance the bass sound of the sound waves outputted directly to the outside from the speaker unit 120. If the sound wave from the sound guide space outlet 113 and the sound wave outputted from the speaker unit 120 have opposite phases, the sound wave from the sound guide space outlet 113 cancels the sound wave outputted from the speaker unit 120 and the sound wave enhancement action cannot be obtained. The speaker device 100 of the present example is designed so as not to cause such a situation.

FIG. 6 is a diagram comparing frequency characteristics (f1) when the actuator 140 of the speaker device 100 in the present example is driven by the audio signal and frequency characteristics (f2) when the actuator 140 of the speaker device 100 is not driven. FIG. 6 shows the characteristics in a low frequency range lower than 200 Hz.

As apparent from the comparison of the characteristics f1 and f2 shown in FIG. 6, in a frequency band lower than approximately 60 Hz, the characteristics f1 when the actuator 140 is driven by the audio signal shows a higher gain. Accordingly, it is found that a speaker device having preferable low frequency range reproduction characteristics can be obtained by driving the actuator 140 with the audio signal. Further, for the characteristics in a frequency range higher than 60 Hz, comparatively flat frequency characteristics are obtained, and it is found that excellent low frequency range characteristics are obtained for a speaker device.

Further, by comparing the characteristics f1 shown in FIG. 6 when the actuator 140 of the speaker device 100 is driven and the characteristics f2 shown in FIG. 6 when the actuator 140 is not driven, it is possible to design the enclosed space C1 and the sound guide space C2 so that the characteristics f1 has a higher gain than the characteristics f2. That is, as shown in FIG. 6, when the characteristics f1 and the characteristics f2 are compared at a frequency around 40 Hz which is the resonance frequency of the actuator 140, the characteristics f1 when the actuator 140 is driven show a higher level than the characteristics f2 when the actuator is not used. Therefore, it is found that the sound wave outputted from the rear surface of the speaker unit 120 vibrates the diaphragm 131 positioned between the enclosed space C1 and the sound guide space C2 in a correct phase.

Further, it is found from the frequency characteristics in the low frequency range that the sound wave outputted from the sound guide space outlet 113 and the sound wave outputted from the front surface of the speaker unit 120 have the same phase.

If the sound wave outputted from the sound guide space outlet 113 and the sound wave outputted from the front surface of the speaker unit 120 have opposite phases, both of the sound waves act so as to cancel each other. In such a case, the output level of the speaker device 100 is reduced at a frequency around 40 Hz which is the resonance frequency of the actuator 140. When the speaker device 100 does not have such a level reduction and also obtains the frequency characteristics f1 showing a higher level than those when the actuator 140 is not driven, it is found that the formation state in each of the spaces C1 and C2 and positioning state of the diaphragm 131 are correct.

Note that the characteristics shown in FIG. 6 show an example of the frequency characteristics, and the state of the enhancement in the low frequency range changes according to the resonance frequency of the actuator 140 and the like.

Each of the configurations of the speaker device shown in FIG. 1 to FIG. 4 and the characteristics of the speaker device shown in FIG. 5 and FIG. 6 shows an example, and the present invention is not limited to these configurations and characteristics. For example, the speaker device may have a shape including the enclosed space C1 and the sound guide space C2 having shapes different from the shapes shown in FIG. 2. Further, while the sound guide space outlet 113 is positioned in the front surface plate 111 in the example of FIG. 1, the sound guide space outlet may be provided at another position. Further, the configuration for supporting the diaphragm 131 within the cabinet 110 may be another configuration.

Further, the actuator 140 attached to the diaphragm 131 may have a configuration different from that of the actuator vibrating the magnet shown in FIG. 4. That is, for the actuator, an actuator having another configuration may be used if the material thereof generates the vibration of the back-and-forth movement according to the inputted audio signal.

Further, in the above example of the embodiment, the full range type speaker unit is used as the speaker unit 120 provided at the speaker device 100. On the other side, a speaker unit which outputs only sound in a low frequency range lower than several hundred Hz, for example, may be used, and the speaker device may function as a woofer dedicated for the low frequency range sound.

REFERENCE SIGNS LIST

90 . . . Audio signal source, 100 . . . Speaker device, 110 . . . Cabinet, 111 . . . Front surface plate, 112 . . . Unit attachment hole, 113 . . . Sound guide space outlet, 114 . . . Top face plate, 115 . . . Bottom face plate, 116 . . . Rear face plate, 117, 118 . . . Side face plate, 120 . . . Speaker unit, 121 . . . Voice coil, 131 . . . Diaphragm, 132, 133 . . . Support member, 134 . . . Separation plate, 135 . . . Partition wall, 140 . . . Actuator, 141 . . . Magnet, 142, 143 . . . Coil, 144, 145 . . . Spring, C1 . . . Enclosed space, C2 . . . Sound guide space

The invention claimed is:

1. A speaker device, comprising:

a speaker unit outputting sound waves according to an inputted audio signal;

a cabinet to which the speaker unit is attached and which is configured to have an enclosed space where a sound wave outputted from a rear surface of the speaker unit is transmitted, a sound guide space separated from the enclosed space and having the same volume as the enclosed space, and an outlet for the sound wave transmitted through the sound guide space;

a diaphragm plate which is positioned between the enclosed space and the sound guide space in the cabinet to separate the enclosed space and the sound guide space; and an actuator to which the audio signal is supplied and which is configured to enhance a vibration state of the diaphragm plate based on the supplied audio signal, the actuator being provided at a surface of the diaphragm plate.

2. The speaker device according to claim 1, wherein the sound wave transmitted through the enclosed space from the rear surface of the speaker unit to the diaphragm plate and the sound wave transmitted through the sound guide space from the diaphragm plate to the outlet have the same phase, and a phase of a sound wave outputted from a front surface of the speaker unit is equal to a phase of the sound wave outputted from the outlet.

3. The speaker device according to claim 2, wherein a resonance frequency of the actuator is set to several tens Hz, and a sound wave having a frequency near the resonance frequency is enhanced.

4. The speaker device according to claim 3, wherein a wood having a predetermined thickness is used for the diaphragm plate.

5. The speaker device according to claim 1, wherein the actuator is separated from the enclosed space or the sound guide space by the diaphragm plate.

6. The speaker device according to claim 1, wherein the diaphragm plate has a stiffness which causes a higher gain, in a frequency range below approximately 60 Hz, when the actuator is driven than when the actuator is not driven.

* * * * *